US005118268A

United States Patent [19]

Crisenbery et al.

[11] Patent Number: 5,118,268

[45] Date of Patent: Jun. 2, 1992

[54] TRAPPED VOLUME VENT MEANS WITH RESTRICTED FLOW PASSAGES FOR MESHING LOBES OF ROOTS-TYPE SUPERCHARGER

[75] Inventors: Richard T. Crisenbery, Homer; Steven K. Kiefer, Battle Creek, both of Mich.

[73] Assignee: Eaton Corporation, Cleveland, Ohio

[21] Appl. No.: 717,741

[22] Filed: Jun. 19, 1991

[51] Int. Cl.[5] ..... F04C 18/16; F04C 29/00

[52] U.S. Cl. ..... 418/189; 418/201.1; 418/206

[58] Field of Search ..... 418/78, 189, 201.1, 418/206, 75

[56] References Cited

U.S. PATENT DOCUMENTS

| | | | |
|---|---|---|---|
| 3,113,524 | 12/1963 | Fulton | 418/131 |
| 3,303,792 | 2/1967 | Littlewood | 418/189 |
| 4,130,383 | 12/1978 | Moinuddin | 418/189 |
| 4,556,373 | 12/1985 | Soeters, Jr. | 418/189 |
| 4,569,646 | 2/1986 | Soeters, Jr. | 418/189 |
| 4,595,349 | 6/1986 | Preston et al. | 418/206 |
| 4,768,934 | 9/1988 | Soeters, Jr. | 418/201.1 |
| 4,828,467 | 5/1989 | Brown | 418/201.1 |
| 4,844,044 | 7/1989 | McGovern | 418/206 |

FOREIGN PATENT DOCUMENTS 282752 5/1928 United Kingdom .

*Primary Examiner*—Richard A. Bertsch
*Assistant Examiner*—David L. Cavanaugh
*Attorney, Agent, or Firm*—P. S. Rulon

[57] ABSTRACT

A rotary positive displacement blower (10) of the Roots-type having inlet and outlet vents recess (60,62) for reducing fluid pressure build up in spaces between meshing, helical lobes (34*a*, 36*a*) on rotating rotors of the blower.

10 Claims, 7 Drawing Sheets 62
24a
22a
32
36f
36d
36g
36
36c
60
104
34g
34
34f
34d
34c
105
107
106
34

TRAPPED VOLUME VENT MEANS WITH RESTRICTED FLOW PASSAGES FOR MESHING LOBES OF ROOTS-TYPE SUPERCHARGER

CROSS REFERENCE TO RELATED APPLICATION

This application is related to U.S. application Ser. No. 717,742 filed Jun. 19, 1991 and incorporated herein by reference.

FIELD OF THE INVENTION

This invention relates to rotary compressors or pumps, particularly to pumps of the backflow type. More specifically, the present invention relates to improving efficiency and reducing airborne noise associated with compression of volumes of air trapped between meshing teeth or lobes of Roots-type blowers employed as superchargers for internal combustion engines.

BACKGROUND OF THE INVENTION

As is known, Roots-type blowers are similar to gear pumps in that both employ toothed or lobed rotors meshingly disposed in transversely overlapping cylindrical chambers. Adjacent nonmeshing lobes of each rotor transfer volumes of inlet port fluid to the outlet port. When the lobes remesh, outlet port fluid is trapped in contracting spaces between the meshing lobes and compressed unless venting is provided. When the rotor lobes are straight, i.e., parallel to the rotor axis, outlet vents have been provided for returning a portion of the trapped fluid to the outlet port and inlet vents have been provided for returning the remainder of the trapped fluid to the inlet port. However, when helical lobes are employed, known outlet vents have not been provided since such outlet vents would provide a leak path from the outlet port to the inlet port via expanding spaces between the meshing lobes. Examples of gear pumps with outlet and inlet vents may be seen by reference to U.S. Pat. Nos. 3,113,524; 3,303,792; and 4,130,383, which are incorporated herein by reference. Examples of Roots-type blowers with helical lobes and inlet vents may be seen by reference to U.S. Pat. Nos. 4,556,373 and 4,569,646, which are incorporated herein by reference.

SUMMARY OF THE INVENTION

An object of the present invention is to provide inlet and outlet vents for trapped volumes between meshing teeth of a backflow blower having helical lobes.

According to an object of the present invention, a rotary pump of the backflow type with helical lobes, as disclosed in U.S. Pat. No. 4,556,373, is provided with vent means for relieving pressure build-up in trapped volumes between meshing lobes of the rotors.

The vent means are characterized by inlet and outlet recesses and fluid flow restriction grooves formed in an end wall surface sealingly related with rotor and lobe end surfaces at trailing ends of the lobes. The outlet and inlet recess means are respectively disposed on opposite sides of a plane defined by axes of the rotors. The outlet recess means communicates the fluid in the trapped volumes to the pump outlet and the inlet recess means communicates the fluid in the trapped volumes to the pump inlet. The outlet recess means includes first and second recess fingers having a substantially unrestricted flow areas in continuous communication with the outlet fluid. The first and second recess fingers have boundary limits disposed such that the trapped volumes of the first pockets respectively disposed between the root surfaces of the first and second rotors and the fore surfaces of the one lobe move from positions initially communicating directly with the associated finger to positions wherein the trapped volumes and the expanding second pockets disposed between the root surfaces and the aft surfaces of the one lobe communicate with the associated recess finger via the flow restriction grooves. Thereafter, the trapped volumes and the expanding second pockets then move to positions directly communicating with the inlet vent recess means.

BRIEF DESCRIPTION OF THE DRAWINGS

A Roots-type blower intended for use as a supercharger is illustrated in the accompanying drawings in which.

DETAILED DESCRIPTION OF THE DRAWINGS

Figure 1:
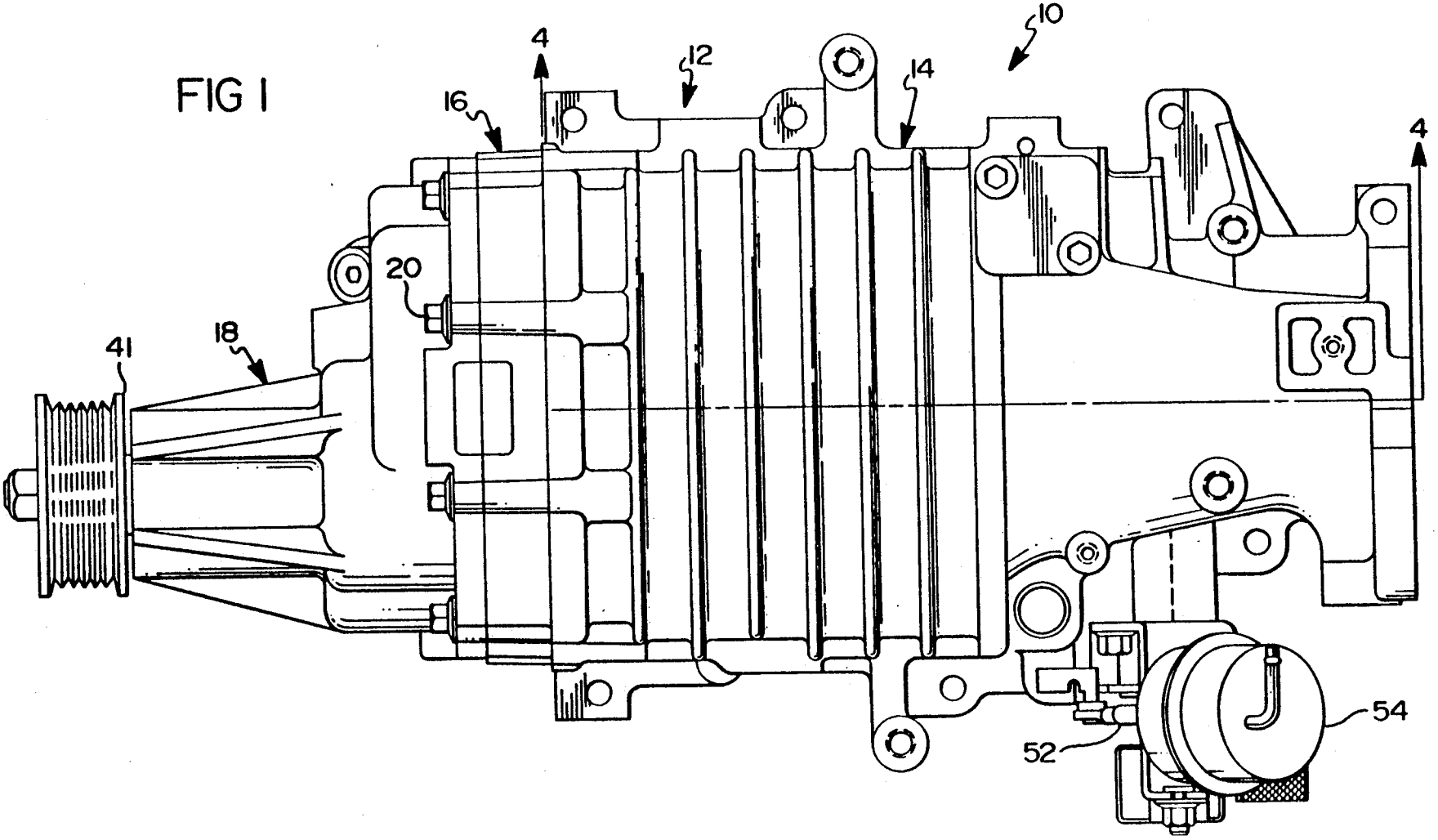
FIG. 1-3 are relief views of the Roots-type blower with FIG. 1 being a top view, FIG. 2 being a bottom view and FIG. 3 being a side view.
Figure 2:
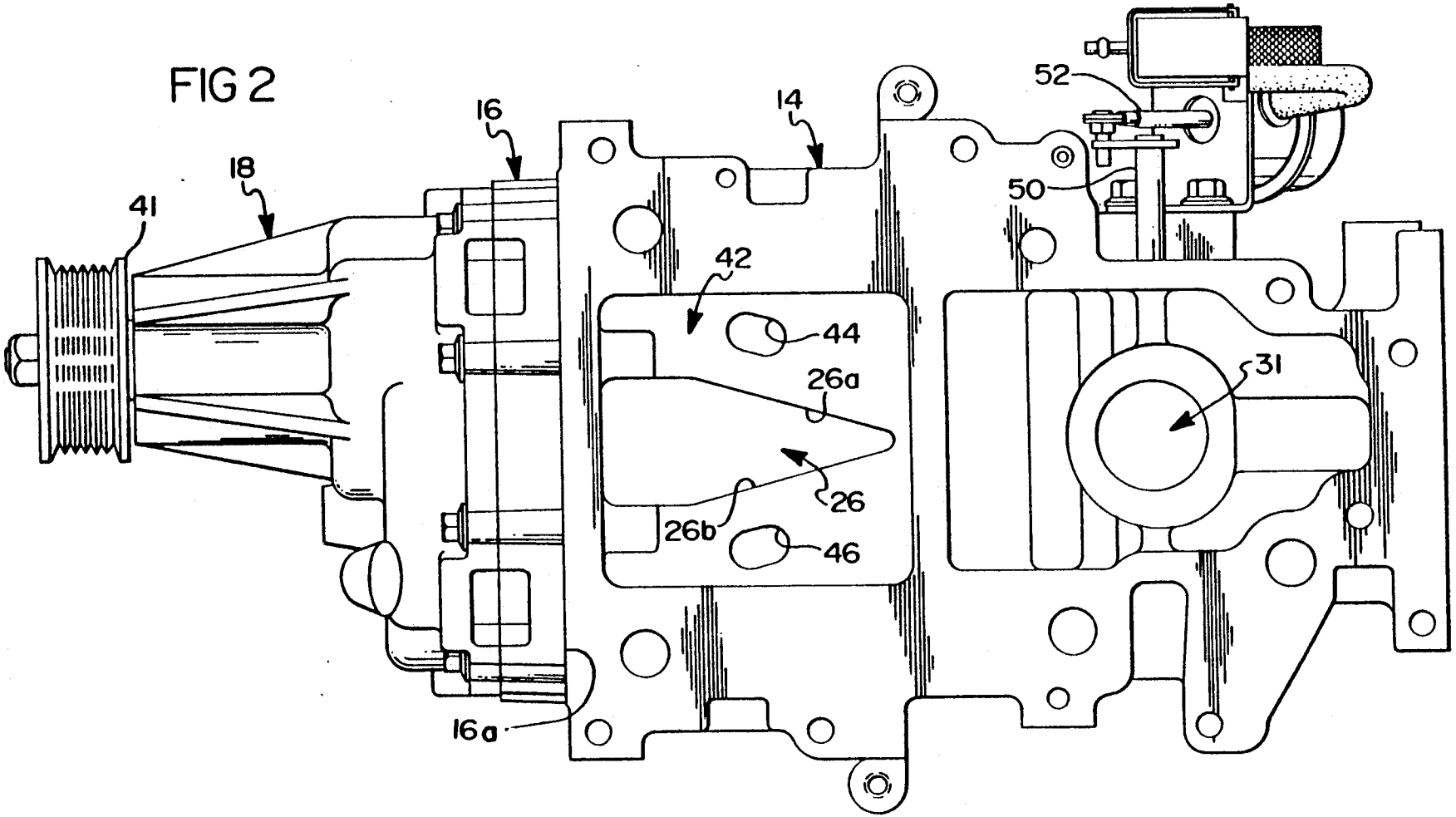
Figure 3:
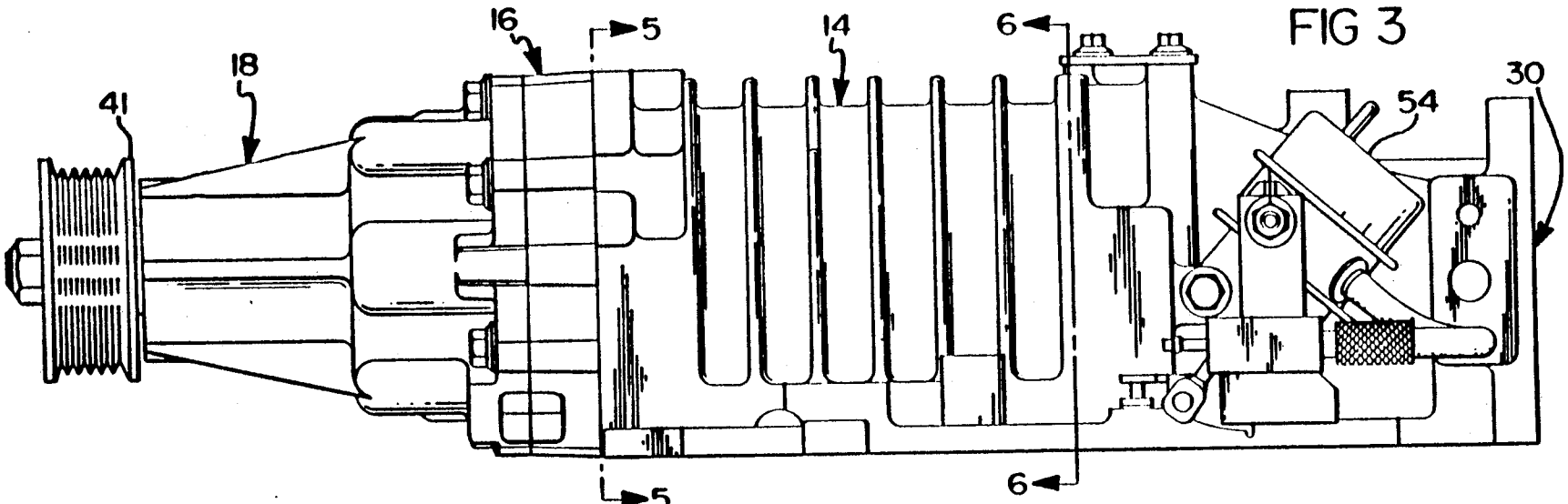
Figure 4:
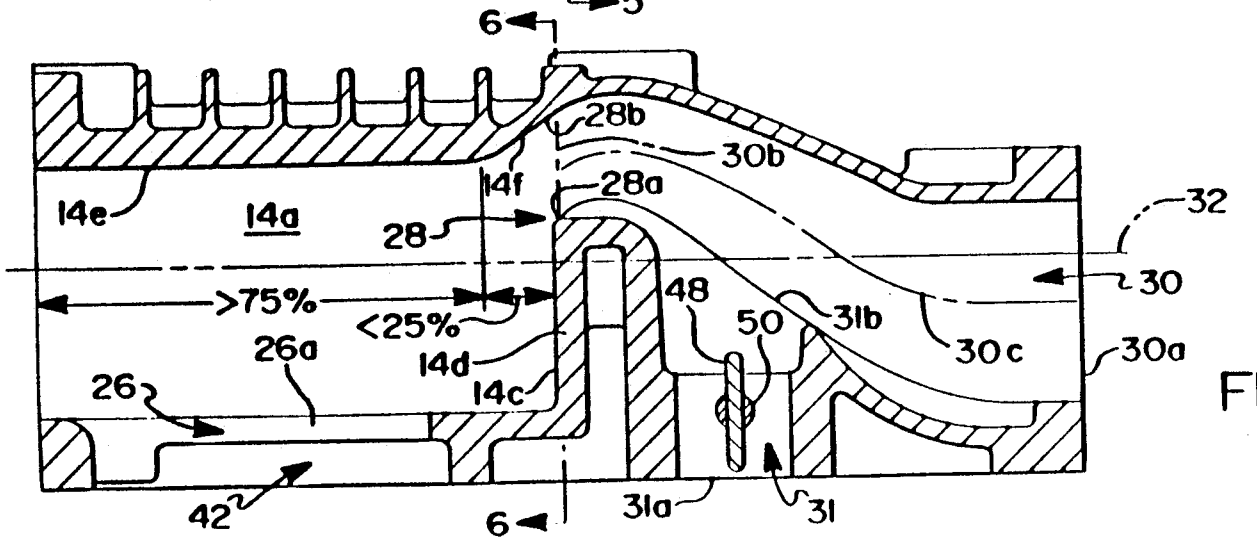
FIG. 4 is a longitudinal cross-sectional view of a housing member in FIGS. 1-3 looking along line 4—4 in FIG. 1.

The drawing figures illustrate a rotary pump or blower 10 of the Roots-type. Such blowers are used almost exclusively to pump or transfer volumes of compressible fluid, such as air, from an inlet port opening to an outlet port opening without compressing the air in the transfer volumes prior to exposure to higher pressure air at the outlet port opening. The rotors operate somewhat like geartype pumps, i.e., as the rotor teeth or lobes move out of mesh, air flows into volumes or spaces defined by adjacent lobes on each rotor. The air in the volumes is then trapped between the adjacent unmeshed lobes as the rear lobe thereof moves into a sealing relation with the wall surfaces of the chambers. The volumes of air are transferred or directly exposed to air at the outlet port opening when the front lobe of each transfer volume traverses the boundaries of the outlet port opening or boundaries of passages for preflowing or backflowing outlet port air at a controlled rate into the upcoming transfer volume.

Blower 10 comprises a housing assembly 12 including a main housing member 14, a bearing plate member 16, and a drive housing member 18. The three members are secured together by a plurality of screws 20. The main housing member 14 is an unitary member defining cylindrical wall surfaces **14*a*, 14*b* and a flat end surface 14*c* of an end wall 14*d* of first and second transversely overlapping cylindrical chambers 22,24. Member 14 also defines an outlet port opening 26, an inlet port opening 28 in end wall 14*d*, a main inlet duct 30, and a bypass duct 31**.

The other end wall of chambers 22,24 is defined by a flat surface 16*a* of bearing plate member 16. Chambers 22,24 respectively have parallel, longitudinal axes 22*a*,24*a* lying in a common plane 32. With reference to position in the drawings, the upper part of wall surfaces 14*a*, 14*b* intersect to define a cusp 14*c* extending parallel to the chamber axes. As disclosed herein, the lower part of the surfaces 14*a*,14*b* do not actually intersect and are joined by a plane 33 parallel to plane 32. Chambers 22,24 respectively have rotors 34,36 mounted therein for counter rotation on shafts 38,40 having axes substantially coincident with the respective chamber axes. Shafts 38,40 are mounted at their opposite ends in known and unshown manner in antifriction bearings supported by bearing plate 16 and end wall 14*d*. The rotors are driven in the direction of arrows A and B by a drive pulley 41 fixed to a drive shaft which in turn drives unshown timing gears affixed to the rotor shafts. Details of mounting and driving the rotors, which form no part of the invention herein, may be obtained by reference to U.S. Pat. Nos. 4,595,349; 4,828,467; and 4,844,044, all of which are incorporated herein by reference.

Rotors 34,36 respectively include three lobes 34*a*,36*a* of modified involute profile having an end-to-end helical twist of 60 rotational degrees. The lobes are circumferentially spaced apart by bottom lands or root surfaces 34*b*,36*b* at the lobe roots or radially inner extents. Each lobe includes fore-and-aft flank surfaces 34*c*, 36*c* and 34*d*,36*d* respectively facing in the direction of rotor rotation, oppositely facing end surfaces 34*e*,34*f* and 36*e*,36*f* which sealingly cooperate with end wall surfaces 14*c*, 16*a*, and top lands or outer surfaces 34*g*,36*g* which sealingly cooperate with the cylindrical wall surfaces 14*a*,14*b* of the respective chamber and when meshing with the roots surfaces of the other rotor. With respect to the direction of rotor rotation, end surfaces 34*e*,36*e* define lead ends of the lobes and end surfaces 34*f*,36*f* define trailing end of the lobes. Radially inward extents of the flank surfaces merge or blend into radially outward extents of the roots surfaces along the length of the lobes in the area designated by action lines 34*h*,36*h* in FIG. 5. The action lines are omitted in FIGS. 7A–7G to avoid undue clutter therein. The helical lobes preferably, but not necessarily, have a twist defined by the relation 360°/2n, wherein n equals the number of lobes per rotor.

Outlet port opening 26 has a somewhat triangular shape disposed intermediate chambers 22,24 and skewed toward the ends of the chambers defined by flat surface 16*a* of the bearing plate member, and completely below common plane 32. Air from opening 26 flows into a rectangular recess 42 in the bottom or base of housing member 14. Preflow or backflow slots 44,46 disposed on opposite sides of the outlet port opening respectively provide for backflow of outlet air in recess 42 to transfer volumes of air trapped by adjacent unmeshed lobes of the rotor prior to traversal of the outlet port boundaries 26*a*,26*b* by the outer surface of the front lobe of each transfer volume. Further detail of the outlet port and backflow slots may be obtained by reference to previously mentioned U.S. Pat. No. 4,768,934 which is incorporated herein by reference. The base of housing member 14 is adapted to be affixed to an unshown manifold, such as an engine manifold, which directs outlet port air from recess 42 to engine combustion chambers and to bypass duct 31.

Inlet port opening 28 extends through end wall 14*d* at a position completely above common plane 32 and adjacent end surfaces 34*e*,36*e* at the lead ends of the lobes. The opening includes radially inner and outer boundaries 28*a*,28*b* with respect to axes 22*a*,24*a* and first and second lateral boundaries 28*c*,28*d*.

Boundaries 28*a*,28*b* are positioned to maximize axial and minimize radial flow of inlet air into the spaces between adjacent lobes of each rotor. Such flow of inlet air mitigates negative effects of centrifugal forces imparted to the inlet air by the rotating lobes even at moderate rotor speeds. Further, since the inlet opening is at the lead ends of the helical lobes, the lobe helix angles impart axial forces on the inlet air which improves or assists flow into the spaces rather than opposes such flow as do centrifugal forces. Radially inner boundary 28*a* is positioned for substantial alignment with the radially inner most extent of root surfaces 34*b*,36*b* of the lobes and radial outer boundary 28*b* is slightly outward of a tangent across the crest or uppermost arc of cylindrical surfaces 14*a*,14*b*. Housing 14 includes a surface 14*f* beginning at outer boundary 28*b* and smoothly tapering into cylindrical surfaces 14*a*,14*b* over an axial distance less than 25% of the axial length of chamber 22,24.

Boundaries 28*c*,28*d* are positioned in circumferentially opposite directions from cusp 14*e* distances sufficient to be substantially untraversed by the aft lobe lead end surface of each transfer volume until the top land at the trailing end of the aft lobe traverses cusp 14*e*. This prior traversal of the cusp prevents a net air loss from substantially mature transfer volumes due to air flow across the top land to emerging transfer volumes at lower pressure.

Figure 5:
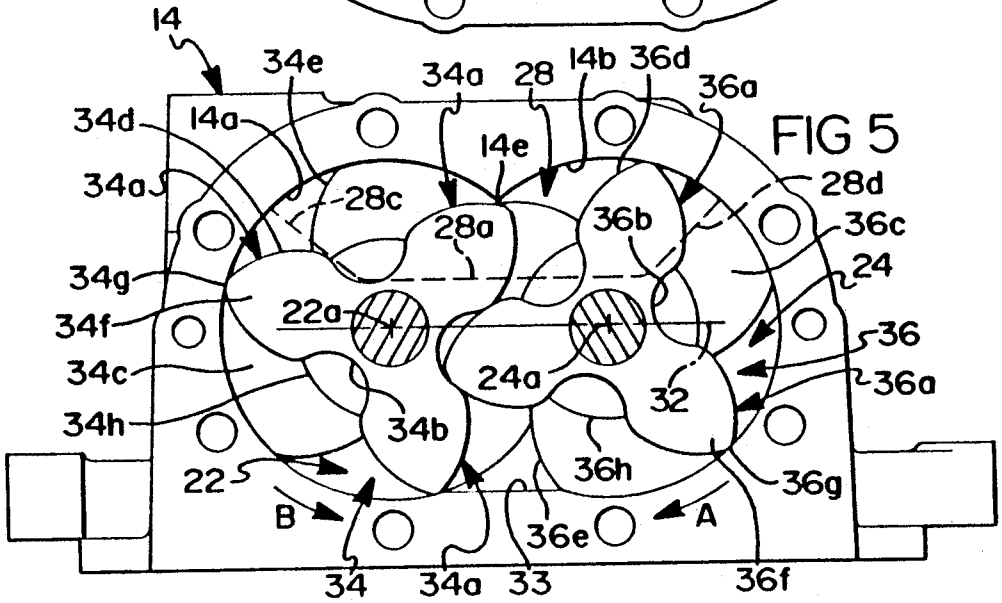
FIG. 5 is a cross-sectional view of the blower looking along line 5—5 in FIG. 3.

Lateral boundaries 28*c*,28*d* may be, and in many applications, such as high rotor speed applications, are preferably, positioned for traversal as long after cusp traversal as possible, thereby increasing the number of rotational degrees each transfer volume is connected to inlet air. For example, with rotors having three 60 degree twist lobes each, lateral boundaries 28*c*,28*d* may be a minimum of about 60 degrees from cusp 14*e*. However, by extending the lateral boundaries to about 85 degrees, as shown in FIG. 5, volumetric efficiency at high rotor speeds improved substantially while low speed volumetric efficiency was substantially uneffected.

Inlet duct 30 includes an end 30*a* adapted to be connected to a source of air in known manner and an end 30*b* defined by inlet port opening 28. Duct 30 has a mean flow path represented by phantom line 30*c* which is disposed below plane 32 at end 30*a*, curves upward across plane 32, and curves slightly downward for smooth transition into inlet port opening 28. Bypass duct 31 includes an inlet 31*a* adapted to receive blower discharge air as previously mentioned, a butterfly valve 48 for controlling bypass air flow in known manner, and an outlet 31*b* which directs the bypass air into inlet duct 30 at an acute angle with respect to the air flow in the inlet duct. This blending of inlet and bypass air reduces air turbulence in passage 30 and therefore mitigates inefficiencies associated with bypass air flow into an inlet duct of a supercharger. The butterfly is affixed to a shaft 50 which is rotated by a link 52. The link is spring loaded in a direction closing the butterfly and moved toward positions opening the butterfly by a vacuum motor 54 or the like in known manner.

Rotation of rotors 34,36 effects alternate meshes of the lobes wherein one lobe 34*a* or 36*a* of one rotor moves into and out of space between the front and rear adjacent lobes of the other rotor. Each mesh includes arcs-of-action defining sealing relation between the outer surface 34*g* or 36*g* of the one lobe of the one rotor and the root surface 36*b* or 34*b* between the front and rear adjacent lobes of the other rotor. The arcs-of-action start at the lobe lead ends 34*e*,36*e* and progress to the lobe trailing ends 34*f*,36*f* in response to continued rotation of the rotors.

Figure 6:
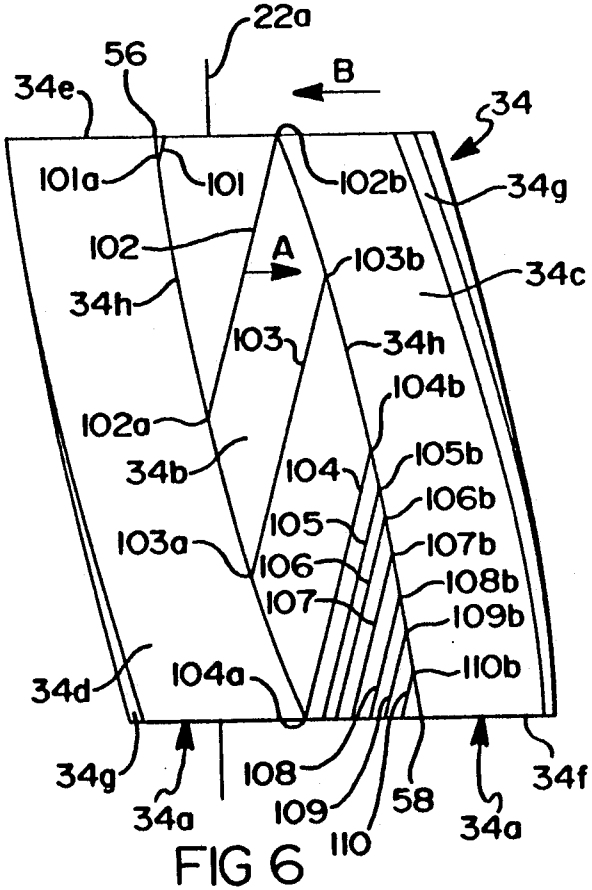
FIG. 6 is a relief view of one blower rotor in free space.

With reference to FIG. 6 and as viewed from axis 24*a*, therein rotor 34 is illustrated in free space with arcs-of-action 101–110 of an infinite family of arcs-of-action extending diagonally across root surface 34*b* as would occur with rotor 34 rotation about axis 22*a* in the direction of arrow B and with rotor 36 rotating about its axis 24*a* in the opposite direction during a mesh cycle. Each family of arcs-of-action for each mesh starts at an intersection 56 of action line 34*h* and lobe lead end 34*e* and progresses incrementally to termination at an intersection 58 of action line 34*h* and lobe trailing ends 34*f*. Each arc-of-action 101–104 has a beginning 101*a*–104*a* and each arc-of-action 102–110 has an ending 102*b*–110*b*. Each beginning arc-of-action is in response to rotor rotation moving successive increments of the outer surface 36*g* of lobe 36*a* into sealing relation with successive incremental portions of root surface 34*b* juxtaposed the radially inner extent of fore surface 34*c* of rear adjacent lobe 34*a* in the area of action line 36*h*. Each incremental beginning of each arc-of-action occurs while a sealing relation exists between the fore surface 36*c* of lobe 36*a* and the aft surface 34*d* of the front adjacent lobe 34*a*. Each ending arc-of-action is in response to rotor rotation moving successive increments of the outer surface 36*g* of lobe 36*a* out of sealing relation with successive incremental portions of root surface 34*b* juxtaposed the radially inner extent of aft surface 34*d* of adjacent lobe 34*a* in the area of action line 34*h*. Each incremental ending arc-of-action occurs while a sealing relation exists between the aft surface 36*d* of lobe 36*a* and the fore surface 34*c* of the rear adjacent lobe 34*a*. Arcs-of-action 102, 103 and 104 are fully developed in that each has a beginning 102*a*, 103*a* and 104*a* and each has an ending 102*b*, 103*b* and 104*b* as previously mentioned. Arc-of-action 101, which has just started to develop has a beginning arc-of-action 101*a* and no ending arc-of-action. Arcs-of-action 105–110, which are moving toward termination, have ending arcs-of-action 105*b*–110*b* and no beginning arcs-of-action. With continued reference to FIG. 6 and additional reference to FIGS. 7A–7G, arcs-of-action 104–110 and intersection 58 of FIG. 6 correspond respectively to the rotor lobe positions of FIGS. 7A–7G with each successive figure representing lobe positions after five rotational degrees of rotor rotation.

Each arc-of-action and the concurrent sealing relations between the fore-and-aft surfaces of the meshing lobes defines first and second pockets extending along the meshed lobes and sealingly separated by the diagonal sealing relation between outer surface 36*g* and root surface 34*b*. The first pockets are formed between fore surface 36*c* of lobe 36*a* and root surface 34*b* between the adjacent front and rear lobes. The volume of each of the first pockets is defined by a maximum spacing between the fore surface 36*c* and root surface 34*b* at the beginning of each arc-of-action; the spacing decreases to a minimum as each ending arc-of-action is approached. In an analogous manner, the volume of each second pocket is defined by a maximum spacing between the aft surface 36*d* and root surface 34*b* at the ending of each arc-of-action; the spacing decreases to a minimum as each beginning arc-of-action is approached. The first pockets open toward the trailing ends of the lobes and the second pockets open toward the lead ends of the lobes. Between intersection 56 and arc-of-action 104, the first pockets are open to the gaseous fluid in outlet 26, thereafter the first pockets become trapped volumes with outlet fluid therein trapped against direct communication with outlet 26 due to the sealing relations between the lobe meshing surfaces, and the sealing relation between lobe trailing end surfaces and end wall surface 16*a* of bearing plate member 16.

Figures 7A, 7B, 7C, 7D:
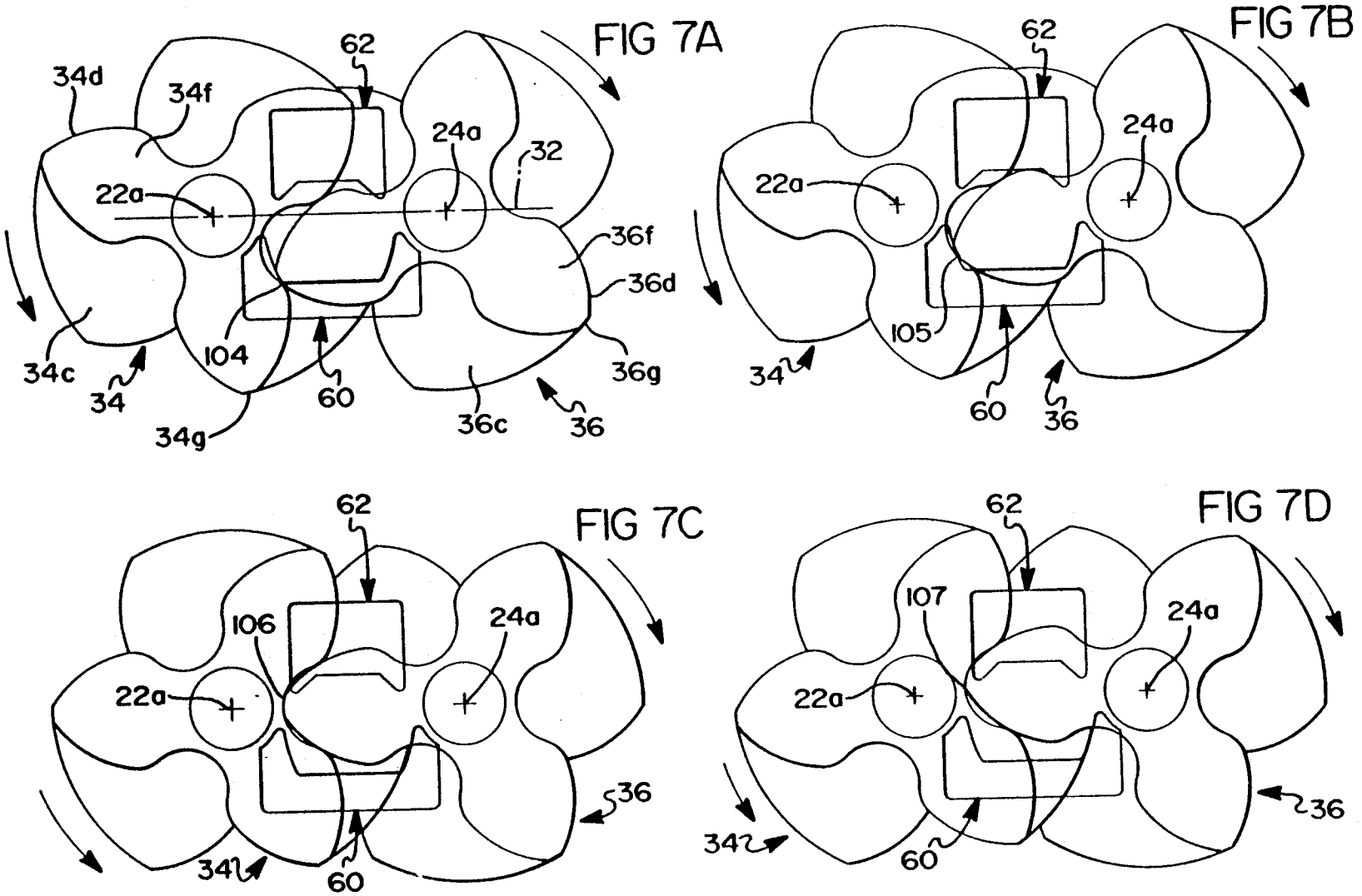
FIGS. 7A-7G illustrate seven meshing positions of the blower rotors in free space.
Figure 7F:
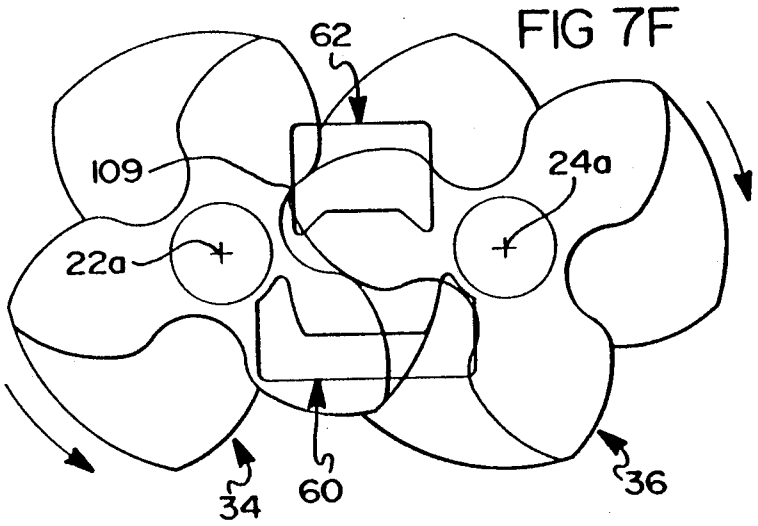
Figure 7E:
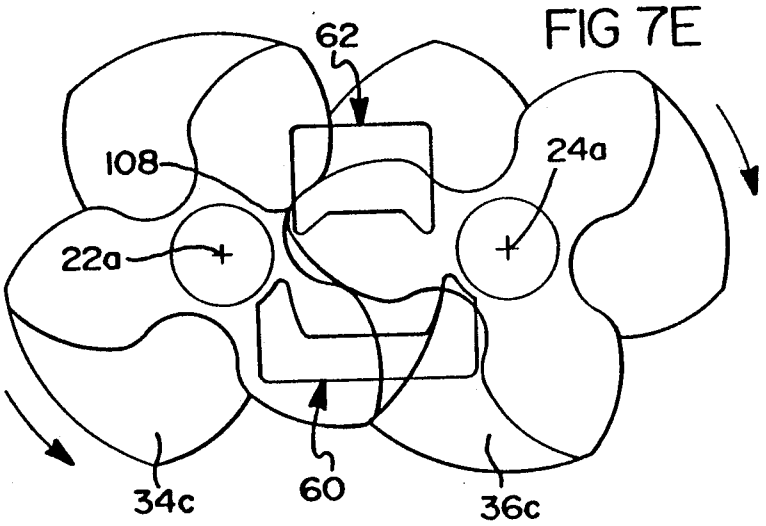
Figure 7G:
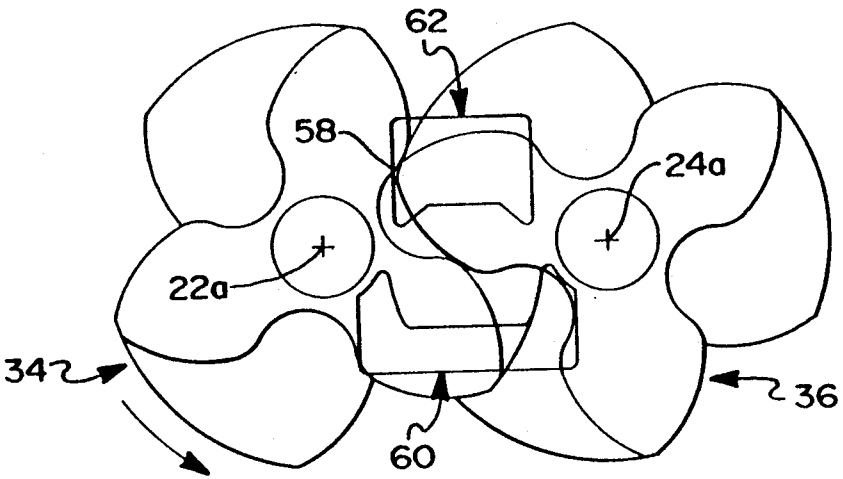

Each trapped volume progressively decreases from a maximum size at arc-of-action 104 and the corresponding lobe position of FIG. 7A to a minimum size just prior to intersection 58 and corresponding lobe position of FIG. 7G. FIGS. 7A–7G illustrate rotors 34,36 in free space and in mesh for rotation about their respective axes 22*a*,24*a*. As the meshing lobes progress through arcs-of-action 104–110 and intersection 58, the foot print of the spacing between fore spaces 36*c* and root surface 34*b* at end wall surface 16*a* decreases while the foot print of the spacing between the aft surface 36*d* and root surface 34*b* increases.

Figure 8:
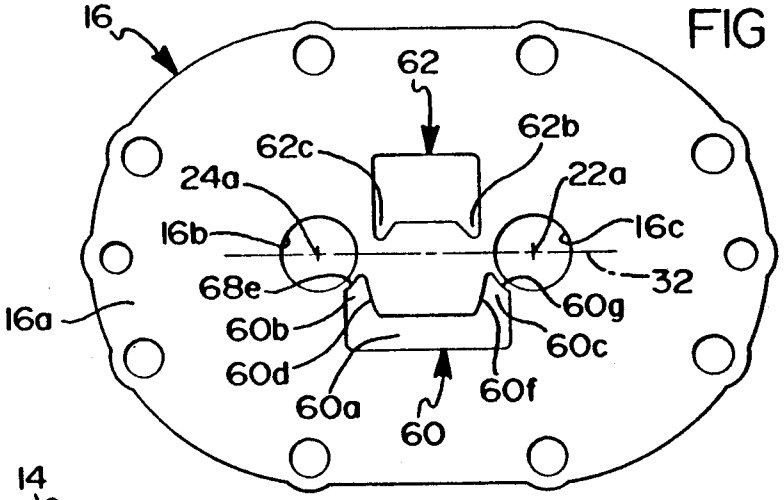
FIG. 8 is a cross-sectional view of the blower looking along line 6—6 of FIG. 3.

With reference to FIG. 8, end wall surface 16*a* of bearing plate member 16 is provided with outlet and inlet vent recesses 60.62 respectively disposed on opposite sides of plane 32 defined by the rotor axes. The outlet recess communicates fluid in the trapped volumes to housing outlet 26 and the inlet recess communicates the remainder of the fluid in the trapped volumes to the housing inlet 26. Both recesses diminish pressure build up in the trapped volumes as they decrease in size. The outlet recess also increases pump efficiency by retaining a portion of the trapped outlet fluid back to the pump outlet. Both vent recesses are shown superimposed on the trailing ends 34*f*,36*f* of rotors 34,36 in FIGS. 7A–7G.

The outlet vent recess 60 includes an elongated recess portion 60*a* extending parallel to plane 32 and in continuous communication with outlet 26, and first and second recess fingers 60*b*,60*c* extending from the ends of recess portion 60*a* toward position wherein portions of fingers 60*b*,60*c* are respectively traversed and communicated with alternately formed contracting trapped volumes respectively associated with root surfaces 34*b*,36*b*. Fingers 60*b*,60*c* respectively have converging boundary limits 60*d*,60*e* and 60*f*,60*g*. Boundary limits 60*d*,60*f* are positioned such that the expanding second pockets are sealed from direct communication with the outlet vent recess, thereby preventing a leak path from housing outlet 26 to housing inlet 28. Boundaries limits 60*e*,60*g* are spaced relatively small distances radially outward of the outer edges of bores 16*b*,16*c* in bearing plate member 16 that shafts 38,40 extend through. Such positioning allows traversal of boundary limits 60*e*,60*g* by the radially innermost extend of root surfaces 34*b*,36*b* to increase the flow area and the time that the trapped volumes are communicated with the outlet vent recess prior to communication with the inlet vent recess.

The inlet vent recess 62 includes a rectangular recess portion 62*a* in communication with inlet 28, and first and second recess fingers 62*b*,62*c* extending from corners thereof toward plane 32 a distance sufficient to establish alternate communication with the alternately formed trapped volumes as they move out of communication with outlet vent recess fingers 60*b*,60*c*.

FIGS. 9,10 and 11,12 illustrate two alternative embodiments of vents 60,62 in FIGS. 7A–7G and 8. The embodiment of FIGS. 9,10 include a primary outlet vent recess 64, primary inlet vent recesses 66,68 which together are equivalent to inlet vent recess 62, and secondary vent grooves 70,72 intercommunicating the primary outlet and inlet vent recesses. Outlet and inlet vent recesses 64 and 66,68 provide, as do vent recesses 60,62, relatively unrestricted flow paths to the outlet 28 and inlet 26. Outlet vent recess 64 includes an elongated recess portion 64*a* extending parallel to the plane 32 and in continuous substantially unrestricted communication with outlet 26 in a manner analogous to outlet vent recess 60. Outlet vent recess 64 also includes first and second recess fingers 64*b*,64*c* extending from the ends of recess portion 64*a* toward positions wherein portions thereof are respectively traversed and communicated with the alternately formed contracting trapped volumes respectively associated with root surfaces 34*b*,36*b*. FIGS. 64*b*,64*c*, in a manner somewhat analogous to fingers 60*b*,60*c*, include converging boundary limits 64*d*,64*e* and 64*f*,64*g*. Boundary limits 64*d*,64*f* are positioned substantially the same as boundary limits 60*d*,60*f*. Boundary limits 64*e*,64*f* are positioned further radially outward of the outer edges of bores 16*b*,16*c* than are boundary limits 60*e*,60*g*, thereby increasing or maintaining structural strength in the area of the land between the bores and boundary limits 64*e*,64*g*. However, such positioning of boundary limits 64*e*,64*g* decreases the flow area and time that the trapped volumes are communicated with the outlet recess.

The effects of such decreased communication are mitigated by secondary vent grooves 70,72 having a rather narrow width W and shallow depth D relative to the recesses. Accordingly, each groove provides a restricted flow path along its length between the outlet and inlet grooves. The restricted flow paths provided by the grooves of course appear to provide a continuous leak path from outlet 26 to inlet 28. However, leakage of outlet fluid to the inlet is substantially mitigated relative to the vents of FIG. 8 due to position of the grooves, due to cyclic pressure in the trapped volumes being greater than the fluid pressure in outlet 26, and due to flow restriction of the grooves. By way of example only, the restricted flow paths of the grooves may be one-tenth the flow paths of the recesses. More specifically, during each mesh cycle, the pressure in the grooves from the trapped volumes is substantially greater than the fluid pressure in outlet 26 and; accordingly, there is no leakage from outlet 26 to inlet 28 during the mesh cycle periods of the grooves. Further, since the foot print of the trapped volumes initially overlie portions of the grooves contiguous to boundary limits 64*d*,64*f*, a greater portion of the trapped volume fluid flows to the outlet vent recess than to the inlet recesses. As the rotors continue to rotate and the second pockets or spaces between the meshing lobes are formed sufficiently to provide an effective flow path therethrough to inlet 28, the pockets though overlying the grooves are spaced sufficient distances from the groove ends contiguous to the outlet boundary limits 64*d*,64*f* such that there is little or no leakage of fluid from outlet 28 due to flow restriction in the grooves and the trapped volume fluid pressure therein.

Figure 10:
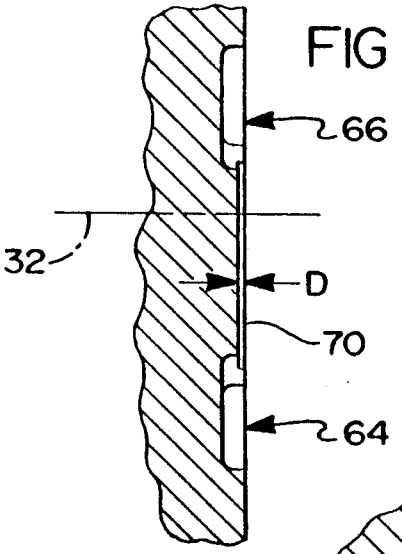
FIGS. 9-12 illustrate two alternative embodiments of features in FIGS. 7A-7G and 8.
Figure 12:
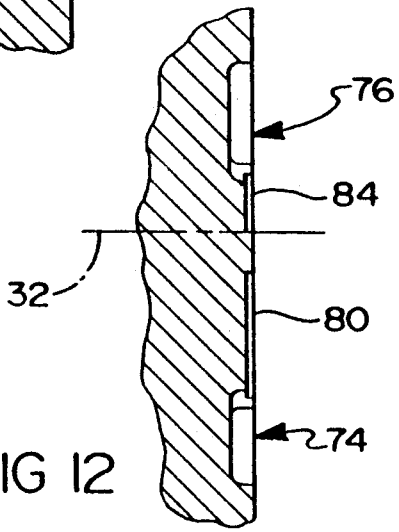
Figure 9:
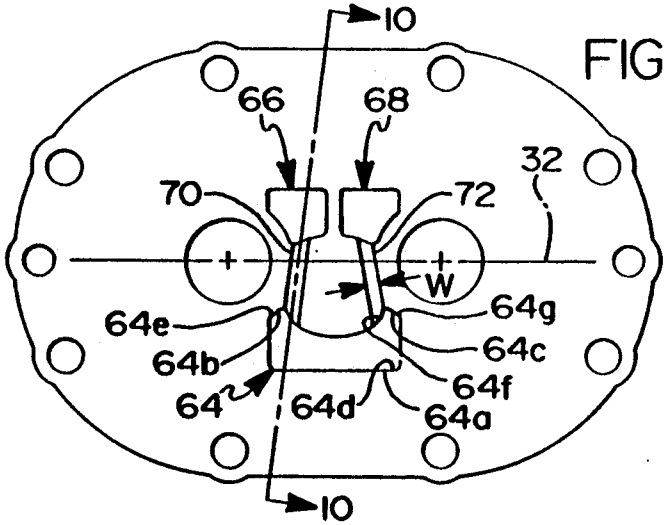
Figure 11:
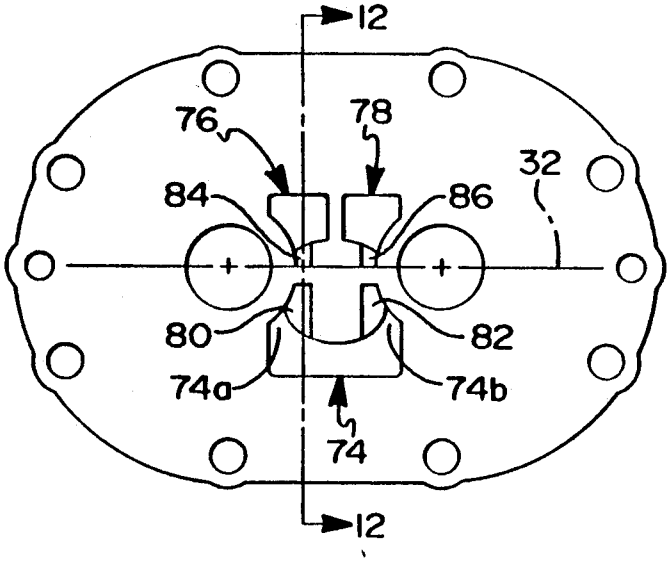

With reference now to the alternative embodiment of FIGS. 11,12, therein are outlet and inlet vent recesses 74 and 76,78, as in FIGS. 9,10, and secondary vent grooves 80,82 extending from fingers 74*a*,74*b* of the outlet vent recess, and secondary vent grooves 84,86 extending from the inlet vent recesses. Grooves 80,84 and 82,86 are discontinuous but functionally the same as grooves 70,72 in that they are sufficiently shallow to provide flow restrictions in the manner of grooves 70,72. However, tests indicate that grooves 80,84 and 82,86 should provide somewhat more restricted flow paths than do grooves 70,72.

A preferred embodiment of the invention has been disclosed in detail for illustrative purposes. Many variations of the disclosed embodiments are believed to be within the spirit of the invention. The following claims are intended to cover inventive portions of the disclosed embodiment and modifications believed to be within the spirit of the invention.

What is claimed is:

1. A rotary pump including a housing defining an inlet and an outlet, and first and second parallel, transversely overlapping cylindrical chambers having cylindrical and end wall surfaces;

first and second meshed lobed rotors respectively disposed in the first and second chambers for transferring volumes of substantially gaseous fluid from the inlet to the outlet via spaces between front and rear adjacent and unmeshed lobes of each rotor in response to rotation of the rotors about their respective axes, the rotors and lobes having end surfaces disposed for sealing relation with the end wall surfaces, the lobes having an end-to-end helical twist such that each lobe has a lead end and a trailing end in the direction of rotor rotation, the lobes of each rotor having a radially outer surface disposed for sealing relation with the cylindrical wall surface of the associated chamber and fore-and-aft surfaces in the direction of rotor rotation and a root surface extending between radially inner extents of the fore-and-aft surfaces of adjacent lobes;

rotation of the rotors effecting meshes of the lobes wherein one lobe of one rotor moves into and out of the spaces between front and rear adjacent lobes of the other rotor, each mesh forming first and second pockets extending along the meshed lobes, the pockets sealingly separated by a sealing relation of the one lobe outer surface extending diagonally across the root surface, the pockets initially formed at the lead ends of the meshing lobes and progressing toward the trailing ends in response to continued rotation of the rotors, the first and second pockets respectively open to the housing outlet and inlet when opposite ends of the diagonal sealing relations are spaced from the lead and trailing ends of the meshing lobes, the first pocket becoming a trapped volume contracting in cross-section and sealed from direct communication with the housing outlet in response to the diagonal sealing relation of the one lobe outer surface initially reaching the trailing ends of the meshing lobes and due to the sealing relation with the associated end wall surface, each trapped volume containing outlet fluid and the volume decreasing from a maximum to a minimum size in response to continued rotation of the rotors, and the second pockets expanding in cross-section in response to the diagonal sealing relation of the one lobe outer surface initially reaching the trailing ends of the meshing lobes;

vent means for relieving pressure build-up in the trapped volumes; characterized by:

the vent means including outlet and inlet recess means and fluid flow restriction grooves formed in the end wall surface sealingly related with the rotor and lobe end surfaces at the lobe trailing ends, the outlet and inlet recess means respectively disposed on opposite sides of a plane defined by the rotor axes, the outlet recess means for communicating a portion of the fluid in the trapped volumes to the housing outlet, the inlet recess means for communicating another portion of the fluid in the trapped volumes to the housing inlet, the outlet recess means including first and second recess fingers having a substantially unrestricted flow area in continuous communication with the outlet fluid in the housing outlet, the first and second recess fingers having boundary limits disposed such that the trapped volumes of the first pockets respectively disposed between the root surfaces of the first and second rotors and the fore surfaces of the one lobe move from positions initially communicating directly with the associated finger to positions wherein the trapped volumes and the expanding second pockets disposed between the root surfaces and the aft surfaces of the one lobe communicate with the associated recess finger via the flow restriction grooves, and the trapped volumes and the expanding second pockets then move into direct communication with the inlet recess means.

2. The rotary pump of claim 1, wherein the restricted grooves include first and second grooves extending respectively from direct communication with the first and second fingers to direct communication with the inlet recess means.

3. The rotary pump of claim 2, wherein the fluid flow restricted grooves have a flow area less than one-tenth the flow area of the outlet vent recess.

4. The rotary pump of claim 1, wherein the restricted grooves include first and second grooves extending respectively from direct communication with the first and second fingers to positions spaced from the plane and third and fourth grooves extending respectively from the inlet recess means toward the first and second grooves to positions spaced therefrom and adjacent the plane.

5. the rotary pump of claim 4, wherein the fluid flow restricted grooves have a flow area less than one-tenth the flow area of the outlet vent recess.

6. A rotary pump including a housing defining an inlet and an outlet, and first and second parallel, transversely overlapping cylindrical chambers having cylindrical and end wall surfaces;

first and second meshed lobed rotors respectively disposed in the first and second chambers for transferring volumes of substantially gaseous fluid from the inlet to the outlet via spaces between front and rear adjacent and unmeshed lobes of each rotor in response to rotation of the rotors about their respective axes, the rotors and lobes having end surfaces disposed for sealing relation with the end wall surfaces, the lobes having an end-to-end helical twist such that each lobe has a lead end and a trailing end in the direction of rotor rotation, the lobes of each rotor having a radially outer surface disposed for sealing relation with the cylindrical wall surface of the associated chamber and fore-and-aft surfaces in the direction of rotor rotation and a root surface extending between radially inner extents of the fore-and-aft surfaces of adjacent lobes;

rotation of the rotors effecting alternate meshes of the lobes wherein one lobe of one rotor moves into and out of the space between front and rear adjacent lobes of the other rotor, each mesh including an arc-of-action having a beginning axially and circumferentially spaced ahead of an ending thereof, the beginning arc-of-action for each mesh starting at the lobe lead ends and progressing to the lobe trailing ends in response to the rotation moving successive increments of the outer surface of the one lobe into a sealing relation with successive incremental portions of the root surface juxtaposed the radially inner extent of the fore surface of the rear adjacent lobe, the beginning arc-of-action occurring while a sealing relation exists between the fore surface of one lobe and the aft surface of the front adjacent lobe, the ending arc-of-action subsequently starting at the lobe lead ends and progressing to the lobe trailing ends in response to the rotor rotation moving the outer surface of the one lobe out of a sealing relation with a portion of the root surface juxtaposed the radially inner extent of the aft surface of the front adjacent lobe, the ending arc-of-action occurring while a sealing relation exists between the aft surface of the one lobe and the fore surface of the rear adjacent lobe, the outer surface of the one lobe defining a sealing relation extending diagonally across the full extent of the root surface while the beginning and ending of each arc-of-action is respectively spaced from the lobe trailing and leading ends;

each arc-of-action defining first and second pockets extending along the meshed lobes and sealingly separated by the sealing relation between the outer surface of the one lobe and the root surface. the first pocket formed between the fore surface of the one lobe and the root surface and the second pocket formed between the aft surface of the one lobe and the root surface, the first and second pockets each having cross-sectional spacing between the root surface and the respective for-and-aft surfaces of the one lobe, the cross-sectional spacing of adjacent incremental portions of the first and second pockets separated by the outer surface of the one lobe and progressively changing respectively from maximum and minimum amounts to minimum and maximum amounts as the arc-of-action goes from the beginning to the ending, the first and second pockets respectively open to the outlet and inlet while the beginning and ending arc-of-action of each is spaced from the lobe trailing and leading ends, each first pocket becoming a contracting trapped volume sealed from direct communication with the outlet in response to the beginning arc-of-action at the lobe trailing ends and the sealing relation with the associated end wall surface, each trapped volume containing outlet fluid and the volume decreasing from a maximum to a minimum as the cross-sectional spacing of the second pocket expands from the minimum to the maximum;

vent means for relieving pressure build-up in the trapped volumes; characterized by:

the vent means including outlet and inlet recess means and fluid flow restriction grooves formed in the end wall surface sealingly related with the rotor and lobe end surfaces at the lobe trailing ends, the outlet and inlet recess means respectively disposed on opposite sides of a plane defined by the rotor axes, the outlet recess means for communicating a portion of the fluid in the trapped volumes to the housing outlet, the inlet recess means for communicating another portion of the fluid in the trapped volumes to the housing inlet, the outlet recess means including first and second recess fingers in substantially unrestricted flow area in continuous communication with the outlet fluid in the housing outlet, the first and second recess fingers having boundary limits disposed such that the trapped volumes of the first pockets respectively disposed between the root surfaces of the first and second rotors and the fore surfaces of the one lobe move from positions initially communicating directly with the associated finger to positions wherein the trapped volumes and the expanding second pockets disposed between the root surfaces and the aft surfaces of the one lobe communicate with the associated recess finger via the flow restriction grooves, the trapped volumes and the expanding second pockets then move into direct communication with the inlet recess means.

7. The rotary pump of claim 6, wherein the restricted grooves include first and second grooves extending respectively from direct communication with the first and second fingers to direct communication with the inlet recess means.

8. The rotary pump of claim 7, wherein the fluid flow restricted grooves have a flow area less than one-tenth the flow area of the outlet vent recess.

9. The rotary pump of claim 6, wherein the restricted grooves include first and second grooves extending respectively from direct communication with the first and second fingers to positions spaced from the plane and third and fourth grooves extending respectively from the inlet recess means toward the first and second grooves to positions spaced therefrom and adjacent the plane.

10. The rotary pump of claim 9, wherein the fluid flow restricted grooves have a flow area less than one-tenth the flow area of the outlet vent recess.

* * * * *